US006540547B2

(12) United States Patent
Zweigle

(10) Patent No.: US 6,540,547 B2
(45) Date of Patent: Apr. 1, 2003

(54) CABLE HARNESS PLUG HAVING A SECURING DEVICE FOR THE CABLE HARNESS

(75) Inventor: Peter Zweigle, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/911,278

(22) Filed: Jul. 23, 2001

(65) Prior Publication Data

US 2002/0055299 A1 May 9, 2002

(30) Foreign Application Priority Data

Aug. 2, 2000 (DE) ..... 200 13 282 U

(51) Int. Cl.[7] ..... H01R 13/58
(52) U.S. Cl. ..... 439/468; 439/464
(58) Field of Search ..... 439/468, 457, 439/456–459, 460, 454, 471, 470, 371

(56) References Cited

U.S. PATENT DOCUMENTS 3,794,960 A * 2/1974 Sugar ..... 439/459
3,936,129 A * 2/1976 Guy ..... 439/464
4,165,145 A * 8/1979 Steinbach ..... 439/350

* cited by examiner

*Primary Examiner*—Renee Luebke
*Assistant Examiner*—Phuongchi Nguyen
(74) *Attorney, Agent, or Firm*—Kenyon & Kenyon

(57) ABSTRACT

A cable harness plug is described, including a housing part for accommodating the contact carriers and a cover, a securing device being provided for securing a cable harness leading to the contact elements on the cable harness plug, and the cable harness being arranged inside a cable protection device provided on the cable harness plug. The securing device includes a retaining strap which forms one piece with the cable protection device. This makes it possible to arrange a cable harness directly on the cable harness plug in a vibration-proof mount and to protect it from mechanical damage at the transition from the cable protection device to the cable harness plug.

15 Claims, 4 Drawing Sheets

Fig. 1
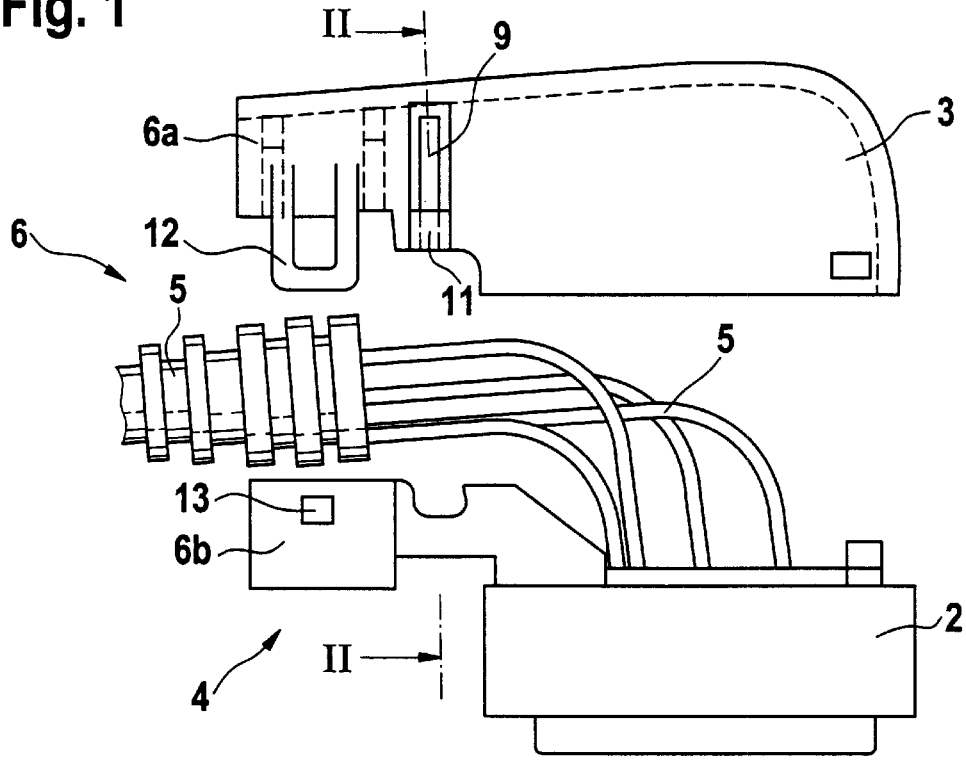
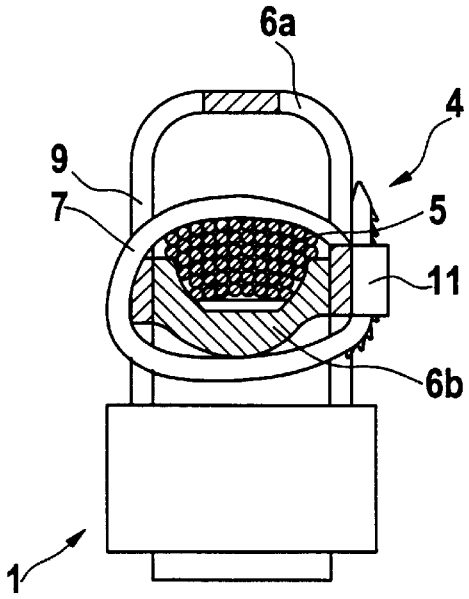
Fig. 2
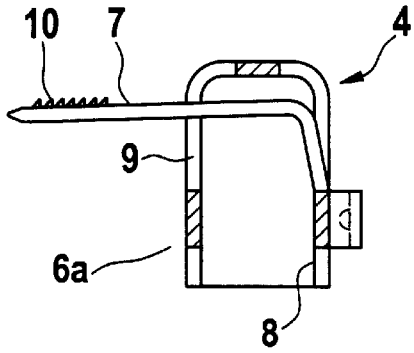
Fig. 3

Fig. 4
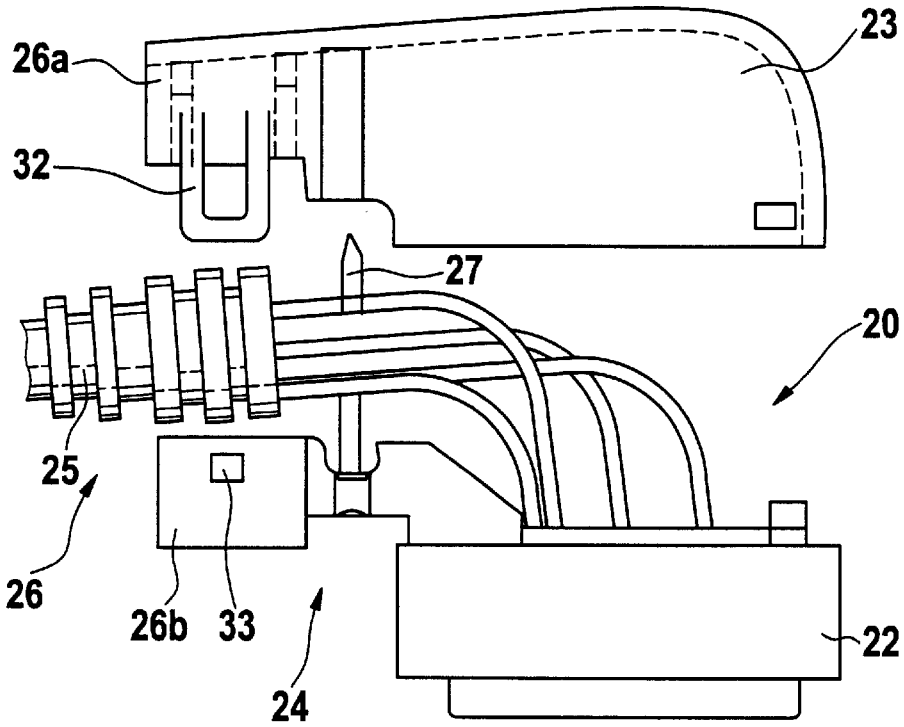
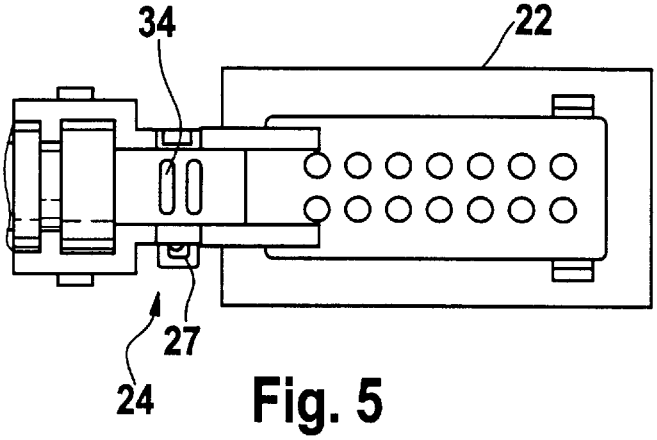
Fig. 5
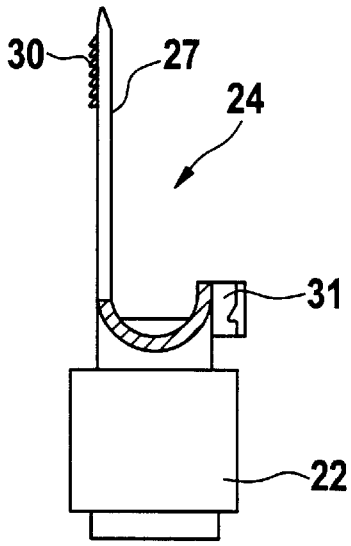
Fig. 6

CABLE HARNESS PLUG HAVING A SECURING DEVICE FOR THE CABLE HARNESS

FIELD OF THE INVENTION

The present invention relates to a cable harness plug for establishing a disconnectable electric plug-and-socket connection with another plug part, including a housing part in which electric contact elements are arranged, and a cover to protect the contact elements, as well as a securing device for securing a cable harness leading to the contact elements on the cable harness plug, the cable harness being arranged inside a cable protection device provided on the cable harness plug.

BACKGROUND INFORMATION

Disconnectable plug-and-socket connections are known in a variety of versions. As a rule, they include a first plug part, e.g., a cable harness plug, and another plug part, e.g., a male connector. The cable harness plug itself includes a contact carrier in the form of a housing part in which the electric contact elements are arranged and a cover to protect the contact elements from dirt, water or the like or unintentional contact. The cover can be latched on the contact carrier. To prevent unintentional opening of the cover and thus detachment from the contact carrier, the cover can be secured by using a securing device, e.g., by a retaining strap.

Furthermore, there are known cable protection devices which are used to guide the cable harness to the contact elements and to protect the cable harness from mechanical stresses in the transitional area from support sleeves, sheathing or the like to the plug part. They are usually composed of two interlocking half-shells with the cable harness inside. The half-shells are usually connected in one piece to the plug part.

One disadvantage of the type mentioned above of cable harness plugs is that it does not permit a vibration-proof arrangement of the cable harness directly on the cable harness plug to protect it from mechanical damage at the transition from the cable protection device to the cable harness plug.

SUMMARY OF THE INVENTION

Therefore, an object of the present invention is to design a cable harness plug of the type mentioned above such that the disadvantages of the related art are avoided.

This object is achieved by the fact that the securing device is composed of a retaining strap which forms one piece with the cable protection device.

One important advantage of the present invention is that a cable harness plug has been created that provides all the elements for assembly of a cable harness on the contact carrier in a simple manner. Therefore, it is no longer necessary to keep an inventory of securing devices.

The cable protection device is preferably made of a grooved tube formed from two half-shells, a first half-shell being arranged on the cover and the other half-shell being arranged on the housing part of the cable harness plug. Therefore, there is a direct connection between the housing part of the cable harness plug and the cable protection device, so that this transition is protected from mechanical damage.

Furthermore, the securing device is designed in the form of a retaining strap which is arranged on the inside of the first half-shell and can be guided and secured through a side opening in the cable protection device around the cable harness and through the opening. The latching device for the retaining strap is preferably arranged on the outside of the cover.

As an alternative, the retaining strap can be arranged on the other half-shell with the same function.

An alternative securing device is designed such that the retaining strap is arranged on the outside of the first half-shell, can be guided around the other half-shell and can also be secured on the first half-shell.

As an alternative, the retaining strap may also be arranged on the other half-shell with the same function.

In the two embodiments mentioned last, the retaining strap in its first function is used to secure the two half-shells relative to one another and to prevent any inadvertent opening of the two half-shells due to vibration.

The other function of the retaining strap is to secure the cable harness in the cable protection device. Therefore, a holding device for the cable harness is provided inside the cable protection device and is designed so that the cable harness is secured by joining the two half-shells in the area of the holding device. The two half-shells preferably have two opposing curvatures arranged with a distance between them. When the half-shells are closed, this causes the cable harness to be secured in a fixed position. To increase this friction-locking effect, the securing device in the form of the retaining strap provided on one of the two half-shells is also preferably accommodated in this area.

A preferred variant of the embodiment mentioned last has in the first half-shell a recess into which the retaining strap provided on the other half-shell engages, so that a shorter retaining strap can be used.

To guarantee that the cable harness will be adequately secured, experiments have shown that the width of the holding device corresponds to the inside distance between the two legs of the first half-shell.

Furthermore, depending on the gauge of the cable harness, additional latching arrangements may also be provided in the embodiments mentioned above for securing the first half-shell on the other half-shell.

BRIEF DESCRIPTION OF THE DRAWINGS

FIG. 1 shows a schematic diagram of a first embodiment of the cable harness plug according to the present invention immediately before joining the cover and the contact carrier.

FIG. 2 shows a section through the cable harness plug according to FIG. 1 along line II—II.

FIG. 3 shows a schematic diagram giving a sectional view of the cable protection device together with the securing device connected to the cable protection device in one piece.

FIG. 4 shows a schematic diagram of a second embodiment of the cable harness plug according to the present invention immediately before joining the cover and the contact carrier.

FIG. 5 shows a top view of the cable harness plug according to FIG. 4.

FIG. 6 shows a schematic diagram of the cable protection device together with the securing device connected to the cable protection device in one piece.

DETAILED DESCRIPTION

First exemplary embodiment (FIGS. 1–3)

Figure 7:
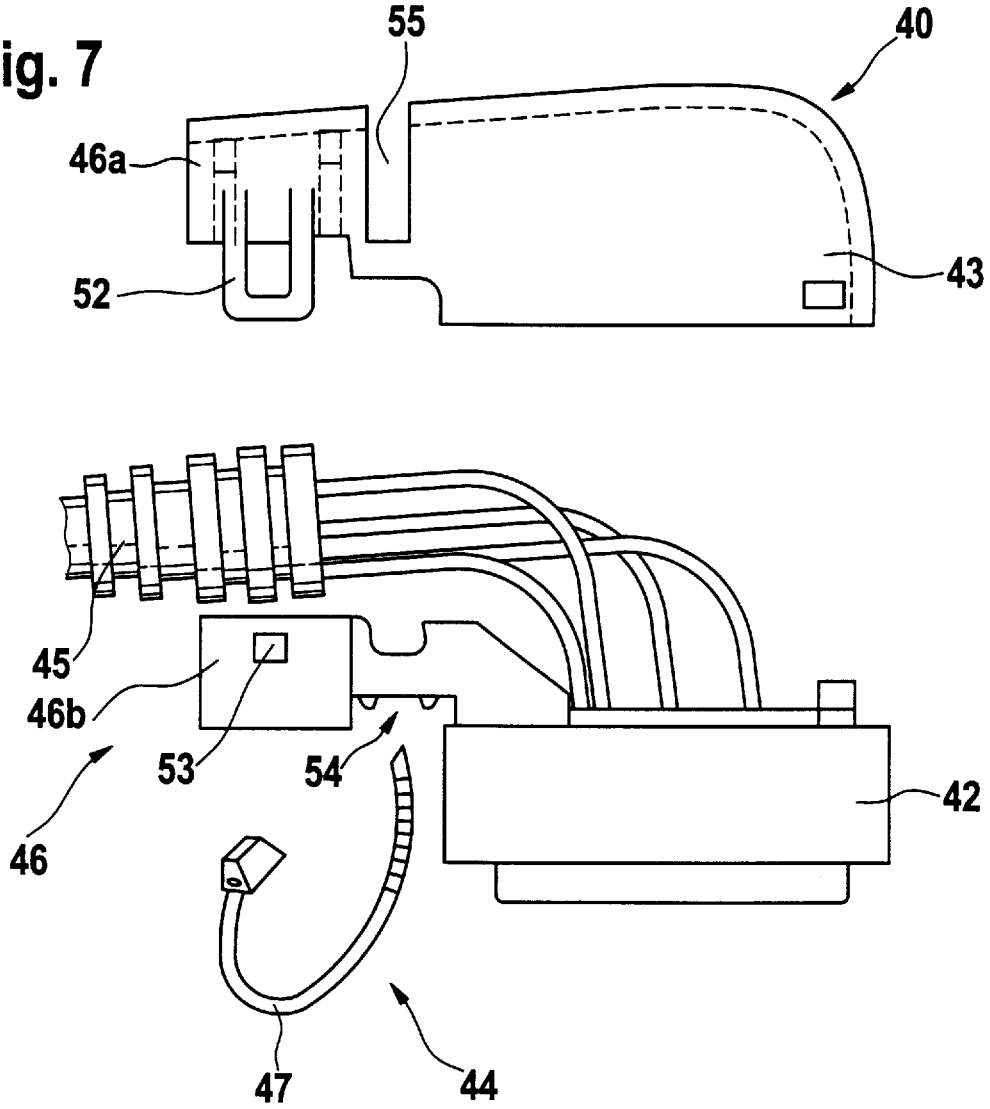
FIG. 7 shows a schematic diagram of a third embodiment of the cable harness plug according to the present invention immediately before joining the cover and the contact carrier.

FIGS. 1 through 3 show the first embodiment of cable harness plug 1 according to the present invention. It includes a housing part 2, corresponding to the contact carrier of a plug part, and a cover 3 to protect the contact carriers.

Furthermore, a securing device 4 is provided for securing a cable harness 5, leading to the contact carriers, on the cable harness plug 1, cable harness 5 being arranged inside a cable protection device 6 provided on cable harness plug 1.

Cable protection device 6 is composed of two half-shells 6*a*, 6*b*, first half-shell 6*a* being connected in one piece to cover 3 and other half-shell 6*b* to housing part 2.

Securing device 4 includes a retaining strap 7 which is arranged on inside 8 of first half-shell 6*a*, as shown in FIG. 3. Before assembly, retaining strap 7 preferably extends out of an opening 9 and has latching elements 10 on its free end.

For assembly and thus for securing cable harness 5 on cable harness plug 1, retaining strap 7 is looped around cable harness 5 inside the cable protection device, latching with its free end in a latching device 11. Cable protection device 6 may already be closed here.

Furthermore, another latching arrangement 12 provided on first half-shell 6*a* works together with corresponding latching arrangement 13 on other half-shell 6*b*, as shown in FIG. 1.

Thus, it can be seen that cable harness 5 is also secured when cable harness plug 1 is assembled.

Second exemplary embodiment (FIGS. 4–6)

FIGS. 4 through 6 show the second embodiment of cable harness plug 20 according to the present invention. It includes a housing part 22, corresponding to the contact carrier of a plug part, and a cover 23 to protect the contact carriers.

Furthermore, a securing device 24 is provided for securing a cable harness 25 leading to the contact carriers on cable harness plug 20, cable harness 25 being arranged inside a cable protection device 26 provided on cable harness plug 20.

Cable protection device 26 is composed of two half-shells 26*a*, 26*b*, first half-shell 26*a* being connected in one piece to cover 23 and other half-shell 26*b* to housing part 22.

Securing device 24 includes a retaining strap 27 which is provided directly on other half-shell 26*b*, as shown in FIG. 6. Before assembly, retaining strap 27 preferably extends perpendicularly away from the guide for cable harness 25 and has latching elements 30 on its free end.

For assembly and thus for securing cable harness 25 on cable harness plug 20, retaining strap 27 is looped around cable harness 25 inside cable protection device 26, latching with its free end in a latching device 31.

Furthermore, another latching arrangement 32 provided on first half-shell 26*a* works together with a corresponding latching arrangement 33 on other half-shell 26*b*, as shown in FIG. 4.

Thus, it can be seen that cable harness 25 is also secured when cable harness plug 1 is assembled.

In addition, a holding device 34 which is used for additional securing of cable harness 25 is provided in the retaining area of retaining strap 27. For this purpose, two elevations are provided in first half-shell 26*a* in the embodiment shown here, which work together with elevations arranged in parallel in other half-shell 26*b* such that cable harness 25 arranged between them is at least presecured when cover 23 is closed.

Figure 8:
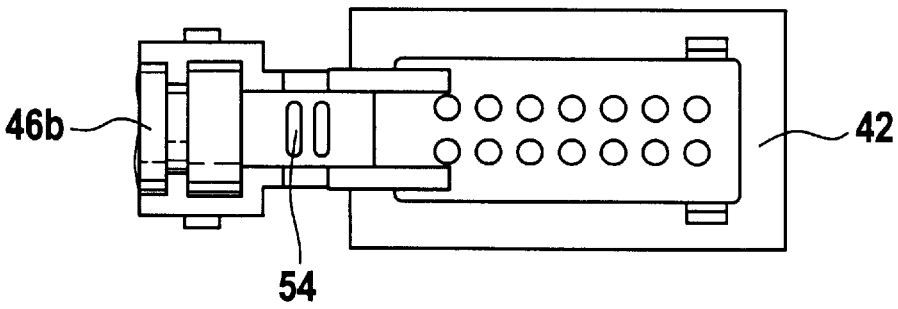
FIG. 8 shows a top view of the cable harness plug according to FIG. 7.

Third exemplary embodiment (FIGS. 7–8)

FIGS. 7 and 8 show the third embodiment of cable harness plug 40 according to the present invention. It includes a housing part 42, corresponding to the contact carrier of a plug part, and a cover 43 to protect the contact carriers.

Furthermore, a securing device 44 is provided for securing a cable harness 45 leading to the contact carriers on cable harness plug 40, cable harness 45 being arranged inside a cable protection device 46 provided on cable harness plug 40.

Cable protection device 46 is composed of two half-shells 46*a*, 46*b*, first half-shell 46*a* being connected in one piece to cover 43 and other half-shell 46*b* to housing part 42.

Securing device 44 includes a retaining strap 47 which is provided directly on other half-shell 46*b*, as shown in FIG. 7, for example.

In addition, a holding device 54 which is used for additional securing of cable harness 45 is provided in the retaining area of retaining strap 47. For this purpose, two elevations are provided in first half-shell 46*a* in the embodiment shown here, which work together with elevations arranged in parallel in other half-shell 46*b* such that cable harness 45 arranged between them is at least presecured when cover 43 is closed.

Furthermore, a recess 55 provided on first cover 43 in the area of the arrangement of retaining strap 47 is designed with dimensions such that it can accommodate retaining strap 47.

For assembly and thus for securing cable harness 45 on cable harness plug 40, cover 43 is first placed on housing part 42. A retaining strap 47 which is provided as the securing device is looped around two half-shells 46*a* and 46*b* and secures cable harness 45 on cable protection device 46 due to holding device 54.

Furthermore, another latching arrangement 52 provided on first half-shell 46*a* work together with corresponding a latching arrangement 53 on other half-shell 46*b*, as shown in FIG. 7.

Thus, it can be seen that cable harness 45 is also secured when cable harness plug 40 is assembled.

Figure 9:
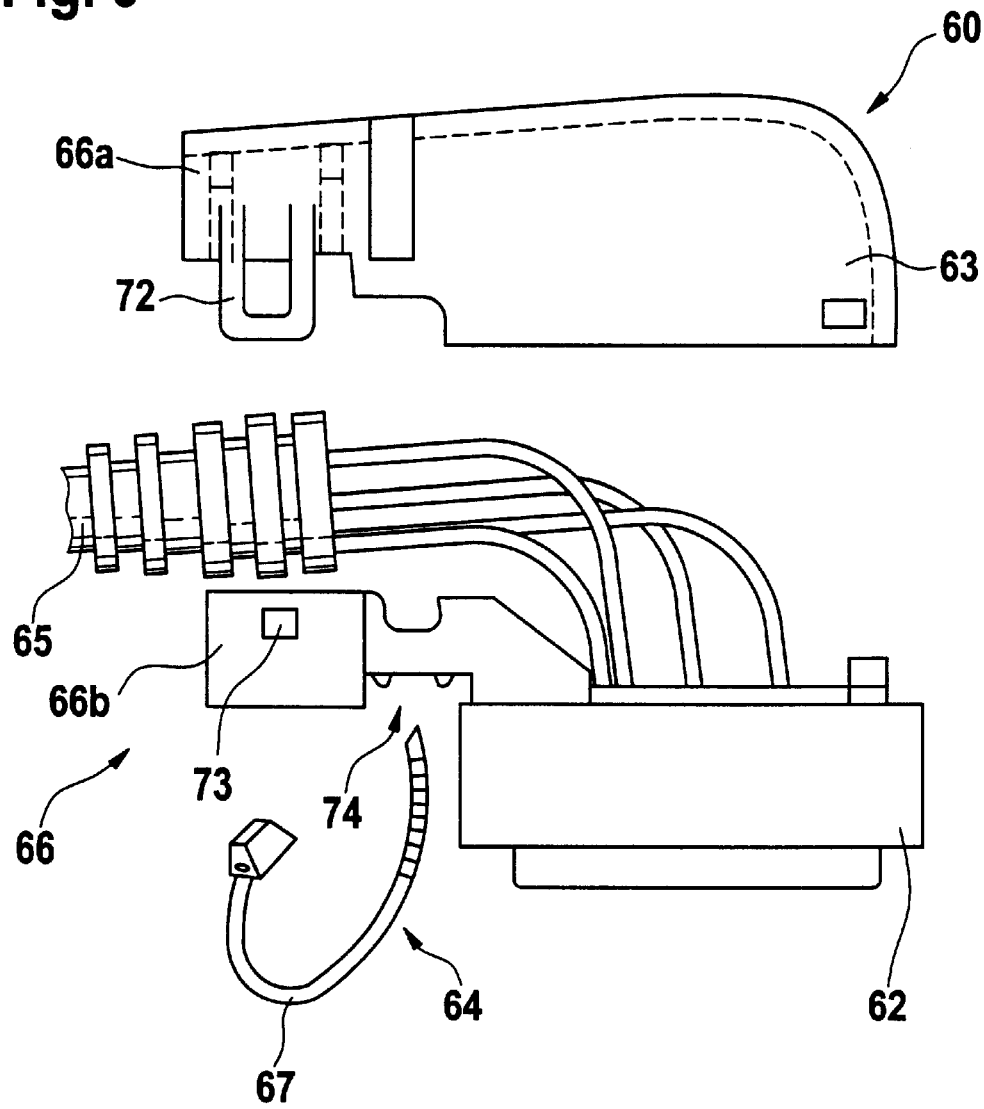
FIG. 9 shows a schematic diagram of a fourth embodiment of the cable harness plug according to the present invention immediately before joining the cover and the contact carrier.
Figure 10:
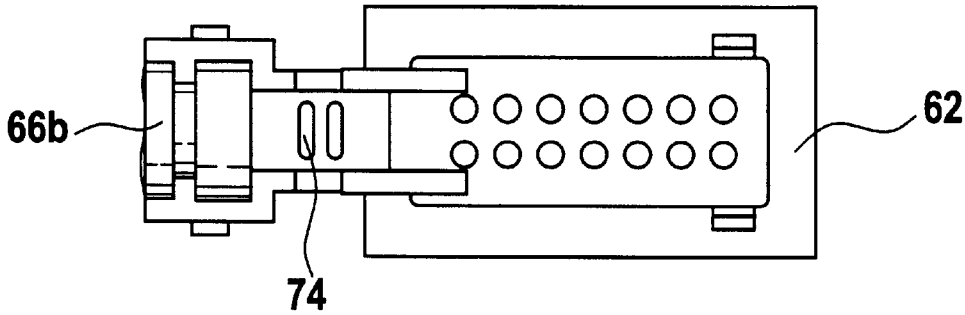
FIG. 10 shows a top view of the cable harness plug according to FIG. 9.

Fourth exemplary embodiment (FIGS. 9–10)

FIGS. 9 and 10 show the fourth embodiment of cable harness plug 60 according to the present invention. This is the simplest form of the present invention. It includes a housing part 62, corresponding to the contact carrier of a plug part, and a cover 63 to protect the contact carriers.

Furthermore, a securing device 64 is provided for securing a cable harness 65 leading to the contact carriers on cable harness plug 60, cable harness 65 being arranged inside a cable protection device 66 provided on cable harness plug 60.

Cable protection device 46 is composed of two half-shells 66*a*, 66*b*, first half-shell 66*a* being connected in one piece to cover 63 and other half-shell 66*b* to housing part 62.

Securing device 64 includes a retaining strap 67 which is provided directly on other half-shell 66*b*, as shown in FIG. 9, for example.

In addition, two elevations 74 are provided in first half-shell 46*a* in the embodiment shown here, which work together with elevations 74 arranged in parallel in other half-shell 46*b* such that cable harness 65 arranged between them is at least presecured when cover 63 is closed.

For assembly and thus for securing cable harness 65 on cable harness plug 60, cover 63 is first placed on housing part 62. A retaining strap 67 which is provided as the securing device is looped around two half-shells 66*a* and 66*b* and secures cable harness 65 on cable protection device 66 due to holding device 74.

Furthermore, another latching arrangement 72 provided on first half-shell 66*a* works together with a corresponding latching arrangement 73 on other half-shell 66*b*, as shown in FIG. 8.

Thus, it can be seen that cable harness 65 is also secured when cable harness plug 60 is assembled.

What is claimed is:

1. A cable harness plug for establishing a disconnectable electric plug-and-socket connection with another plug part, comprising:

a plurality of electric contact elements;

a housing part in which the electric contact elements are arranged;

a cover for protecting the electric contact elements; and a securing device for securing a cable harness, leading to the electric contact elements, on the cable harness plug, the cable harness being arranged inside a cable protection device provided on the cable harness plug, wherein:

the securing device includes a retaining strap that forms one piece with the cable protection device and the cable protection device includes two half-shells, a first of the two half-shells being connectable in one piece to the cover and a second of the two half-shells being connectable to the housing part.

2. The cable harness plug according to claim 1, wherein the retaining strap is arranged on an inside of the first half-shell and is configured to be guided and secured through a side opening in the cable protection device around the cable harness and through the opening.

3. The cable harness plug according to claim 1, wherein the retaining strap is arranged on the other half-shell, is configured to be guided around the cable harness, and is configured to be secured on the other half-shell.

4. The cable harness plug according to claim 1, wherein the retaining strap is arranged on an outside of the first half-shell, is configured to be guided around the other half-shell, and is configured to be secured on the first half-shell.

5. The cable harness plug according to claim 1, wherein the retaining strap is arranged on an outside of the other half-shell, is configured to be guided around the first half-shell, and is configured to be secured on the other half-shell.

6. The cable harness plug according to claim 1, further comprising:

a holding device for the cable harness, the holding device being arranged inside the cable protection device and configured to secure the cable harness by joining the first half-shell and the other half-shell in an area of the holding device.

7. The cable harness plug according to claim 1, further comprising:

an additional latching arrangement to secure the first half-shell on the other half-shell.

8. A cable harness plug for establishing a disconnectable electric plug-and-socket connection with another plug part, comprising:

a plurality of electric contact elements;

a housing part in which the electric contact elements are arranged;

a cover for protecting the electric contact elements; and a securing device for securing a cable harness, leading to the electric contact elements, on the cable harness plug, the cable harness being arranged inside a cable protection device provided on the cable harness plug, wherein:

the securing device includes a retaining strap that forms one piece with the cable protection device, and the cable protection device is made of a grooved tube formed from a first half-shell arranged on the cover and another half-shell arranged on the housing part.

9. The cable harness plug according to claim 8, wherein:

the retaining strap is arranged on an inside of the first half-shell and can be guided and secured through a side opening in the cable protection device around the cable harness and through the opening.

10. The cable harness plug according to claim 8, wherein:

the retaining strap is arranged on the other half-shell, can be guided around the cable harness, and can also be secured on the other half-shell.

11. The cable harness plug according to claim 8, wherein:

the retaining strap is arranged on an outside of the first half-shell, can be guided around the other half-shell, and can also be secured on the first half-shell.

12. The cable harness plug according to claim 8, wherein:

the retaining strap is arranged on an outside of the other half-shell, can be guided around the first half-shell, and can also be secured on the other half-shell.

13. The cable harness plug according to claim 8, further comprising:

an additional latching arrangement for securing the first half-shell on the other half-shell.

14. The cable harness plug according to claim 8, further comprising:

a holding device for the cable harness, the holding device being arranged inside the cable protection device and for securing the cable harness by joining the first half-shell and the other half-shell in an area of the holding device.

15. The cable harness plug according to claim 14, wherein:

the first half-shell is a U-shaped first half shell, the other half-shell is a U-shaped other half-shell, and a width of the holding device corresponds to an inside distance between the U-shaped first half-shell and the U-shaped other half-shell.

* * * * *